United States Patent [19]

Tokushima et al.

[11] 4,399,768

[45] Aug. 23, 1983

[54] APPARATUS FOR THE SURFACE TREATMENT OF AN OBJECT

[75] Inventors: Yasuo Tokushima; Kenji Fukuta; Yoshinobu Takahashi, all of Toyota, Japan

[73] Assignee: Toyota Jidosha Kogyo Kabushiki Kaisha, Toyota, Japan

[21] Appl. No.: 318,418

[22] Filed: Nov. 5, 1981

[30] Foreign Application Priority Data

Jan. 29, 1981 [JP] Japan ..... 56-12031

[51] Int. Cl.[3] ..... C23F 7/08; B05C 3/00; B05C 19/02

[52] U.S. Cl. ..... 118/423; 118/429; 118/603; 118/610; 148/6.15 R; 148/6.152

[58] Field of Search ..... 148/6.15 R, 6.152; 118/429, 423, 610, 603

[56] References Cited

U.S. PATENT DOCUMENTS 3,992,300 11/1976 Hill ..... 118/603 X
4,196,023 4/1980 Rowe ..... 148/6.15 R
4,287,004 9/1981 Murakami et al. ..... 148/6.15 R

FOREIGN PATENT DOCUMENTS 2818160 11/1978 Fed. Rep. of Germany ..... 148/6.15 R
2039538 8/1980 United Kingdom ..... 148/6.15 R

*Primary Examiner*—Michael R. Lusignan
*Attorney, Agent, or Firm*—Oblon, Fisher, Spivak, McClelland & Maier

[57] ABSTRACT

An apparatus for applying surface treatment on an object-to-be-treated which is continuously moved in a treating liquid usually by a hanging conveyor. The apparatus is provided at the bottom portion of a treating vessel with one or more hoppers, which function to collect the deposited sludge for exhausting the same through the lower portion of the hoppers outside the treating vessel. Further, the apparatus is provided with a plurality of slant plates disposed above the bottom of the treating vessel, being inclined in the same direction, with a predetermined inter-distance among them, so as to facilitate sludge produced in the vessel to be gradually deposited down on the bottom thereof.

9 Claims, 4 Drawing Figures

APPARATUS FOR THE SURFACE TREATMENT OF AN OBJECT

FIELD OF THE INVENTION

This invention relates to an apparatus for surface treatment effectively applicable for treating or finishing the surface of metal articles or objects when chemical coating, plating, etching, etc., is carried out.

BACKGROUND OF THE INVENTION

Various methods have conventionally been known for treating or finishing the surface of metal articles, such as chemical coating, plating, etching, etc. Above all chemical conversion treatment for forming some kinds of corrosion resistant films on the surface of steel plates or steel bars by means of chemical reaction or electro-chemical reaction is known, and more particularly phosphating, wherein zinc phosphate, manganese phosphate, ferrous phosphate, etc., are employed, is widely known. And it is widely practiced as a method of surface preparation when steel members are coated in the field of, for example, car assemblying, bridge building, or manufacturing of household electrical appliances.

When practicing such a surface treatment, objects-to-be-treated must be in general contacted with the treating liquid, and either of two ways, a spraying method in which the liquid is sprayed over the surface of the objects-to-be-treated or a dipping method in which the objects are dipped in the liquid, is selected for contacting the objects with the liquid. The former spraying method is unsuitable for treating objects of complicated shape, for example car bodies which have portions difficult to be uniformly treated by spraying, such as a fender, a door, or a constructed part in a box-like shape. The liquid is liable not to sufficiently reach the inside surface of complicated corner, sometimes leaving untreated portions or unsatisfactorily treated portions. The latter dipping method is much better than the former in respect of the liquid reaching many quarters of the objects-to-be-treated, but it still leaves something to be desired because the sludge by products are deposited on the bottom of the treating vessel during dipping of the objects-to-be-treated into the liquid, so as to cause some troubles in a continuous surface treatment.

In a chemical conversion process as one of the surface treatments, more specifically speaking, chemical reaction taking place between a steel plate as an object-to-be-treated and a treating liquid containing phosphate which produces crystal coating on the surface of the steel plate. In the course of this chemical reaction, however, by-products called sludge are produced. This chemical conversion sludge created in the course of a secondary reaction did not give rise to serious trouble in the conventional spray method as shown in FIG. 1 wherein phosphate conversion coating was made on the surface of the object $W_1$ by means of the spraying S, because the forced pressure of the spraying S naturally prevented depositing of the sludge onto the coated surface of the object $W_1$. The sludge has however recently become a serious factor for deteriorating the quality of the articles since the surface treatment had been gradually changed to the full dipping treatment method, wherein the object is completely dipped in the treating liquid. In this full dipping method, the sludge is liable to float in suspension in the treating liquid. This kind of chemical conversion sludge not only floats in a treating vessel containing the liquid but is also stirred up from the bottom of the vessel on which it has once been deposited due to the movement of the object-to-be-treated in the vessel. The sludge possibly stuck to the crystal coating or contained in the formed coating deteriorates the corrosion resistance of the coating or adversely affects the resulting electro-depositing process. It is therefore highly desirable to discharge or exhaust such harmful problem-arising sludge out of the vessel.

Conventionally, leading of the liquid out of the system or vessel, by recycling the liquid with equipment shown in FIG. 2, was practiced for removing the sludge. In this equipment, roughly speaking, the liquid containing high density sludge collected in a hopper 4 disposed at the bottom of a treating vessel 2 is led to a sludge removing apparatus 8 through a conduit 6 by the action of a pump $P_1$. The liquid is separated from the sludge by slits 10 disposed in the sludge removing apparatus 8 and is recycled to an overflow tank 14 (recovering tank) of the treating vessel 2 through a conduit 12 by the action of a pump $P_2$. It is again recycled, together with the liquid which is overflowed from the treating vessel 2 into the overflow tank 14, to the treating vessel 2 through a conduit 16 by the action of a pump $P_3$ for being circulated within the treating vessel 2. Numeral 18 designates the surface of the liquid.

The sludge removing apparatus 8 disposed outside the vessel is apt to occupy a substantial space and impose a substantial cost. It is naturally accompanied by some other problems such as complicated piping for recycling, increasing of the recycled amount of the liquid, etc., and a still unsolved problem is stirring up of the deposited sludge on the vessel bottom.

SUMMARY OF THE INVENTION

It is a primary object of this invention, which was derived from such a background, to provide an apparatus for surface treatment, being substantially relieved of the conventional disadvantages, capable of continuously removing sludge produced in the full dipping method from the bottom of a treating vessel.

It is an object of this invention to provide a surface treatment technique for effective prevention of stirring up, and removal, of sludge deposited in a treating vessel employed in a chemical conversion process.

It is another object of this invention to provide an apparatus for surface treatment having enhanced quality of treatment by preventing the once deposited sludge from being stirred up into a treating liquid by disposition of a multiplicity of slant plates functioning as protective walls, at the bottom portion of a treating vessel.

Other objects of this invention will become apparent to those skilled in the art from the following detailed description of the preferred embodiments when read in conjunction with the accompanying drawings.

The apparatus for performing the above-mentioned surface treatment in accordance with this invention is provided, as an essential feature, at the bottom portion of a treating vessel with one or more hoppers, which function to collect the deposited sludge for exhausting the same through the lower portion of the hopper outside the treating vessel. Another essential feature of this invention is provision of a plurality of slant plates disposed above the bottom of the treating vessel containing the treating liquid for performing an aimed for surface treatment by dipping an object-to-be-treated in a treating liquid such as chemical conversion solution like phosphate; the slant plates are disposed, being inclined in the same direction, with a predetermined inter-distance among them. The sludge produced in the treating liquid is gradually precipitated, while being floated therein, on the bottom of the vessel through the gap or clearance between the slant plates, which are not contacted with the vessel bottom. This disposition of the slant plates facilitates the sludge produced in the vessel to be gradually deposited down on the bottom of the plates functioning as protecting walls, with the sludge almost not being affected by the flowing of the liquid and the movement of the objects-to-be-treated. In such an apparatus the deposited sludge can not be stirred up into the liquid again by virtue of the slant plates, but can be easily taken away out of the vessel.

BRIEF DESCRIPTION OF THE DRAWINGS

A few concrete examples will be described hereunder with reference to the appended drawings, in which.

DETAILED DESCRIPTION OF THE PREFERRED EMBODIMENTS

Figure 1:
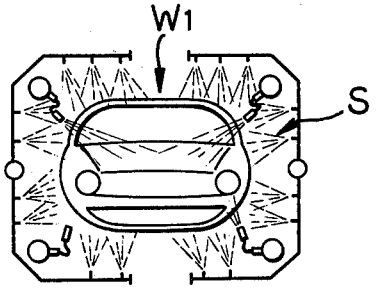
FIG. 1 PRIOR ART
FIG. 1 is a schematic cross-sectional view of a conventional surface treatment apparatus.
Figure 2:
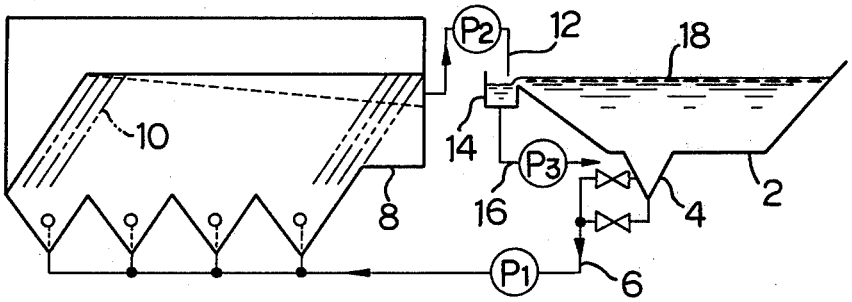
FIG. 2 PRIOR ART
FIG. 2 is a schematic transverse sectional view of a conventional surface treatment apparatus adopting full-dipping method.
Figure 3:
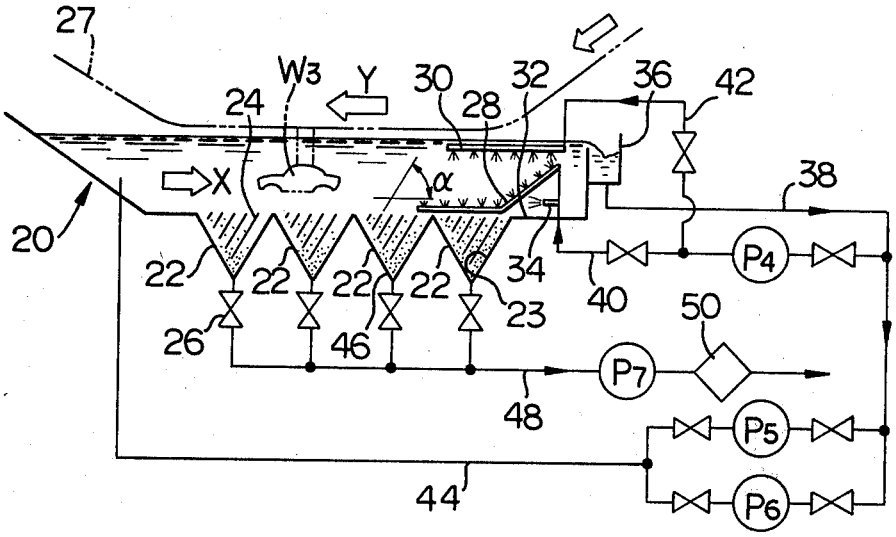
FIGS. 3 and 4 are respectively a schematic transverse sectional view of different embodiments of an apparatus for surface treatment in accordance with this invention.

An apparatus shown in FIG. 3 relates to, for example, zinc phosphating process as a preliminary treatment on an object-to-be-treated $W_3$ such as a car body when it is applied with coating. As a first step for applying the zinc phosphate treatment, the object $W_3$ is degreased with a trichloroethylene or alkaline solution, followed by water cleaning and contact with titanium phosphate solution as a second step. In this way nuclei of phosphate coating crystals are formed on the surface of the object $W_3$. The object $W_3$ which has been applied with such surface preparation is conveyed, being suspended from a hanging conveyer 27 as shown in FIG. 3, from right to left for being dipped into treating liquid at the right part of a treating vessel 20.

The object $W_3$ which has been dipped into the treating liquid at the initial stage of the process, i.e., right end of the treating vessel 20, is gradually conveyed toward the final stage on the left side end for being completely covered in the meantime by the continuously grown zinc phosphate crystals all over the surface thereof. The time required for this process is within the range of 60–300 seconds.

In the embodiment of this invention shown in FIG. 3, a treating vessel 20 of different shape from the prior art is disposed for containing zinc phosphating solution which is a kind of known liquid for chemical conversion treatment. This vessel 20 is provided with four hoppers 22 of funnel shape at the bottom portion thereof, being horizontally arranged in series in parallel to a conveying direction Y of the objects-to-be-treated $W_3$. Within those hoppers 22, a multiplicity of slant plates 24 inclined by an angle ($\alpha$) of 45°–90° against the conveying direction of the objects $W_3$ are arranged parallel with each other and being spaced from a wall surface 23 of the hopper 22 by a predetermined distance, viz., being not in contact therewith. Those slant plates 24 function as protector walls for preventing the deposited sludge from being stirred by the flowing movement of the treating liquid. Besides, each hopper 22 is provided at the lower end thereof with a one-way valve 26.

The treating vessel 20 is further provided with the following devices: a slant gush-spraying pipe 28 and a horizontal gush-spraying pipe 30 disposed on the rightward end portion, in FIG. 3, of the vessel 20 for gush-spraying the treating liquid to the objects $W_3$ which are moved by a inclined conveyor 27 into the liquid in the vessel 20; a gushing nozzle 34 disposed, above a horizontal bottom portion 32 of the vessel 20 on the rightward side away from the hoppers 22, in communication with the slant gush-spraying pipe 28, for gushing the liquid toward the hoppers; and a recovering tank 36 acting as a reservoir for the liquid overflowed out of the treating vessel 20. The gush-spraying pipes 28 and 30 have a suitable number of gush-spraying openings or holes.

In this embodiment of such a structure the objects $W_3$ are transported in suspended state from the conveyor 27 in the direction designated with the arrow Y for being dipped into the liquid, while a part of the liquid in the recovering tank 36 is led, via conduits 38, 40, to the slant gush-spraying pipe 28 and via conduits 38, 42 to the horizontal gush-spraying pipe 30 by the action of a pump $P_4$, for being gush-sprayed onto the just incoming objects $W_3$. The rest of the liquid in the recovering tank 36 is led, by the action of pumps $P_5$, $P_6$ and via conduits 38, 44, back into the vessel 20 for being recycled, while making a counterflow to the direction designated by an arrow X of the movement of the objects $W_3$ in the liquid, to the recovering tank 36.

In the initial stage of the dipping of the objects $W_3$, from the beginning of dipping to the start of leftward movement in FIG. 3 after the complete dipping, strong or vehement chemical reaction progresses between the object $W_3$ and the treating liquid while producing a large amount of sludge. The sludge falls by the action of gravity into each of the hoppers 22 extended from the lower portion of the vessel 20, and sludge on the horizontal portion 32 is collected into the hoppers 22 by virtue of the gush-spraying of the liquid from the gushing nozzle 34 disposed on the conduit 40. The sludge dropping into the hoppers 22 comes first onto the parallel arranged slant plates 24 and then drops through the gap therebetween as far as the wall surface of the individual hoppers 22, for finally being collected along the wall surface in the lower portion 46 of the respective hopper 22. The sludge collected there in this way is intermittently delivered to a separater 50, by the action of a pump $P_7$, via the one-way valves 26 and the conduit 48. The liquid containing the thus collected sludge is separated at the separater 50, which is located out of the recycling circuit, for being returned to the recovering tank 36 or to a gush-spraying device disposed on the final stage side of the vessel 20.

As the slant plates 24 arranged parallel with each other in the lower portion of the vessel 20, and particularly in this case within the hoppers 22, are inclined against the flowing direction X of the liquid, i.e., the same direction as the object conveyance, stirring of the sludge collected in the lower portion 46 by the liquid flowed into between the slant plates 24 can not occur. And the conveyance operation of the objects as well as the gush-spraying of the liquid from the slant gush-spraying pipe 28 and the horizontal gush-spraying pipe 30 can not cause stirring of the sludge, either, because the slant plates 24 prevent the phenomenon by functioning as protector walls. In other words, the above described structure effectively protects the objects-to-be-treated $W_3$ from being deteriorated in quality by sticking of the sludge floating or stirred up from the lower portion 46 of the hopper 22 in the course of the surface treatment. As described earlier, the sludge deposited on the horizontal portion 32 is also removed therefrom into the lower portion 46 of the hopper 22 by the gushing of the liquid from the gushing nozzle 34, which means complete relief of the sludge from the bottom portion of the vessel 20. This invention can be said to have succeeded, through remarkable decrease of the floating and depositing sludge, in improving the quality of the surface treatment, particularly the anti-corrosion coating quality, of the objects-to-be-treated $W_3$.

In the description of the above embodiment, all of the hoppers 22 arranged in series are of the same size, but a modified type wherein the nearest hopper 22 to the object-incoming side end is made the largest in capacity and others are made gradually smaller toward the leftward end is preferably recommended, because the sludge producing rate is largest at the initial stage of contact between the object $W_3$ and the liquid.

Figure 4:
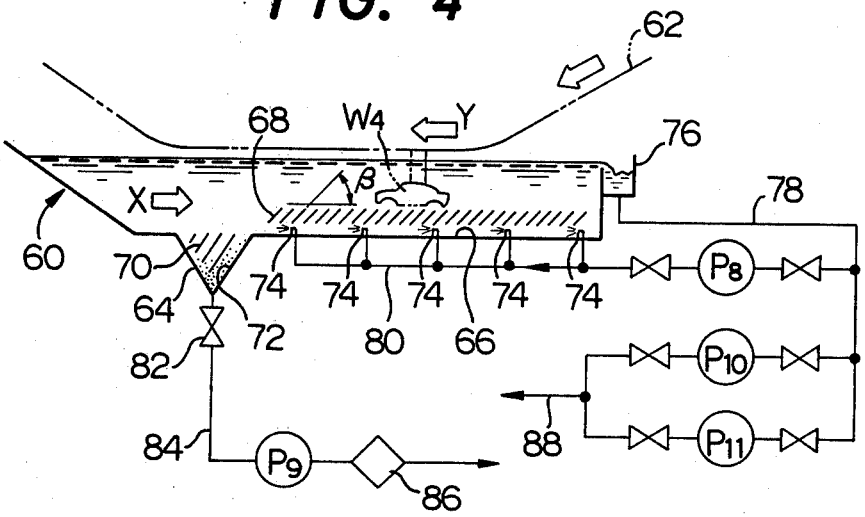

Still another embodiment will be described with reference to FIG. 4, wherein an object $W_4$ suspended by a conveyor 62 is, after is has been completely dipped in zinc phosphating solution contained in a treating vessel 60, moved therein for being given chemical conversion treatment just like in the previous embodiment. The only difference lies in the structure of the bottom portion of the vessel 60. In this embodiment only one hopper 64 of funnel shape is formed at the leftward end of the bottom portion, and the rest of the bottom portion is left as a flat portion 66. Above the flat portion 66 a multiplicity of slant plates 68 inclined at an angle ($\beta$) of 45°–90° are arranged, parallel to each other with a predetermined interdistance, in the horizontal direction and along the conveyance direction Y of the objects-to-be-treated $W_4$. They are not in contact with the flat portion 66, just like slant plates 70 which are similarly arranged in the hopper 64 parallel with each other are kept away from a wall surface 72 of the hopper 64 by a predetermined distance.

On the flat portion 66 a suitable number of gushing nozzles 74 are arranged parallel thereto for gushing the liquid toward the hopper 64 so as to wash away the deposited sludge thereon.

When an object $W_4$ suspended from a conveyor 62 is transported in the direction designated with an arrow Y to be dipped into the liquid in the vessel 60, producing of the sludge is begun by the chemical conversion treatment. And the sludge thus produced is precipitated through the clearance(s) between the slant plates 68 and onto the flat portion 66 of the vessel 60 and also to the lower portion of the hopper 64 along the slant plates 70 while passing the clearance(s) therebetween. The liquid in a recovering tank 76 is, via conduits 78, 80 and by the action of a pump $P_8$, led to each of the gushing nozzles 74 for being gushed therefrom respectively. The sludge deposited on the flat portion 66 is therefore collected to the hopper 64 passing through the clearance formed between the slant plates 68 and the flat portion 66. The sludge collected in the hopper 64 is led via a one-way valve 82 and a conduit 84, by the action of a pump $P_9$, to a separater 86 which is located outside the recycle circuit of the liquid. The separated liquid in the separater 86 is returned to a recovering tank 76 or to a gush-spraying device disposed on the final stage side of the vessel 60. The remaining liquid in the recovering tank 76 is led, via conduits 78, 88 and by the action of pumps $P_{10}$ and $P_{11}$, to the vessel 60 for being flowed in the direction designated with an arrow X so as to be reused in the chemical conversion treatment of the objects $W_4$.

As the slant plates 68, 70 are, just like in the previous embodiment, inclined in the reversed direction X of that of the flowing of the liquid, they not only prevent the liquid from flowing therebetween but also prevent the deposited sludge from being stirred up when the objects $W_4$ are moved in the liquid, by functioning as protective walls.

This embodiment is particularly important in eliminating the need for many hoppers and consequently for simplifying the structure of the bottom portion of the vessel, and also in providing a uniform shape of, as well as reducing the size of, the slant plates.

In the foregoing embodiments the slant plates 24, 68, 70 are all inclined with an angle ($\alpha$, $\beta$) of 45°–90° in the conveying direction of the objects W, the direction marked by the arrow Y, that is, reversed against the flowing direction of the liquid marked the arrow X. The inclined direction of the slant plates has the same sense as the direction of conveyance of the objects W for the better effect of the slant plates as protective walls. But this invention is not limited to this arrangement. A multiplicity of slant plates inclined in the inverted direction to the above embodiments are also allowable. As to the angle of inclination ($\alpha$, $\beta$) of the slant plates 24, 68, 70, in this instance, the preferable range lies within 45°–90°, as an angle larger than 45° is favorable for smoothly sliding down the sludge without staying on the plate, an angle less than 45° being contrary undesirable because of easy piling up of the sludge on the plate. This tendency of arresting the sludge from smoothly falling down from the surface of the plate consequently obliges the plate to be curtailed its length according to the extent of turbulence of the treating liquid.

Summarising the above described details of this invention, structure of the bottom portion of the treating vessel used for the surface treatment has been improved, accompanied by disposition of a multiplicity of slant plates functioning as protective walls, with a remarkable result of preventing the sludge from being stirred up in the course of the treatment for being smoothly removed out of the treating vessel. This effect of having enhanced the quality of treatment by preventing the once deposited sludge from being stirred up into the treating liquid and the recycling efficiency of the treating liquid by effectively removing the sludge therefrom is very significant from the standpoint of industrial efficiency.

What is claimed as new and desired to be secured by Letters Patent of The United States is:

1. An apparatus for applying a predetermined surface treatment to an object by means of dipping the object in a treating liquid and conveying said object in a direction, said apparatus comprising:

a treating vessel containing the treating liquid for performing the predetermined surface treatment;

at least one hopper of funnel shape disposed at the bottom portion of the treating vessel in which the object is dipped, said at least one hopper collecting precipitated sludge therein, the collected sludge being removed out of said at least one hopper through the lower portion thereof; and a multiplicity of slant plates inclined in the same direction with respect to said direction of conveyance and disposed above the bottom portion of the treating vessel in spaced relation with one another so that floating sludge in the liquid may fall through the clearances between the slant plates onto the bottom portion of the treating vessel, said slant plates preventing the sludge from being stirred up into the treating liquid.

2. An apparatus in accordance with claim 1 wherein said slant plates are arranged in said at least one hopper.

3. An apparatus in accordance with claim 1 or claim 2 wherein the multiplicity of slant plates inclined in the same direction are disposed in a horizontal arrangement above a flat portion of the bottom of said treating vessel, said flat portion being positioned where said at least one hopper is not disposed, and wherein at least one gushing nozzle is disposed above said flat portion for spouting a gushing liquid to wash away the sludge precipitated on the flat portion into said at least one hopper.

4. An apparatus in accordance with claim 1 wherein the angle formed between said slant plates and the direction of conveyance of the object is within the range of 45°–90°.

5. An apparatus in accordance with claim 1 wherein said object is continuously moved in said conveying direction said predetermined surface treatment while it is dipped in said treating liquid contained in said treating vessel.

6. An apparatus in accordance with claim 1 wherein said surface treatment is a phosphating process for forming a phosphate conversion coating on the surface of said object.

7. An apparatus in accordance with claim 1 or claim 5, further including a conduit connected to the lower portion of said at least one hopper for removing the sludge and further including solid-liquid separating means disposed in the conduit.

8. An apparatus in accordance with claim 5, further comprising an overflow outlet disposed on the side of said treating vessel where said object is initially dipped in said treating liquid, a recovering tank for storing the overflowed treating liquid, and a return passage for returning the liquid from the recovering tank to the treating vessel, the return passage having one end connected to the recovering tank and the other end connected to the other side of the treating vessel so that a counterflow of the liquid in a direction opposite to the direction of conveyance of the object is created in the treating vessel.

9. An apparatus in accordance with claim 5 or claim 8, further comprising gush-spraying means disposed on the object-introducing side of said treating vessel so that the object introduced into said treating liquid may be gush-sprayed with the liquid by the gush-spraying means.

* * * * *